United States Patent [19]

Densmore

[11] Patent Number: 4,642,855

[45] Date of Patent: Feb. 17, 1987

[54] BELT AND BUCKLE CONNECTOR

[75] Inventor: Lin B. Densmore, San Francisco, Calif.

[73] Assignee: The Meilin Corporation, San Francisco, Calif.

[21] Appl. No.: 779,440

[22] Filed: Sep. 24, 1985

[51] Int. Cl.[4] ..... A44B 11/00

[52] U.S. Cl. ..... 24/310; 24/182; 24/580; 2/338

[58] Field of Search ..... 24/310, 307, 308, 309, 24/163 K, 182, 265 R, 265 BC, 117, 49 K, 580, 3 C, 3 M; 2/338, 339

[56] References Cited

U.S. PATENT DOCUMENTS

| | | | |
|---|---|---|---|
| 74,649 | 2/1868 | Whitney | 24/580 |
| 546,420 | 9/1895 | Dreyfus | 2/338 |
| 856,639 | 6/1907 | Hitchcock et al. | 24/182 |
| 908,006 | 12/1908 | Humphrey | 24/310 |
| 1,327,434 | 1/1920 | Jones | 24/310 |
| 1,698,114 | 1/1929 | Agnini et al. | 24/310 |
| 2,065,202 | 12/1936 | Weidhorn | 24/310 |
| 2,324,430 | 7/1943 | Schalet et al. | 24/310 |
| 3,952,383 | 4/1976 | Moore et al. | 24/265 R |
| 4,161,806 | 7/1979 | Hennisse et al. | 24/580 |
| 4,562,620 | 1/1986 | Oliver, Jr. | 24/163 K |

*Primary Examiner*—Victor N. Sakran

*Attorney, Agent, or Firm*—Owen, Wickersham & Erickson

[57] ABSTRACT

A belt and buckle combination wherein the buckle has a female connector member on its rear side adapted to receive a male connector member attached to each end of a flexible belt. The female connector member has an irregular shaped opening with a central area large enough to receive a knob portion of each male connector, and radially extending arms of said opening that are narrow enough to retain the knob portion when there is tension on the belt.

4 Claims, 8 Drawing Figures

BELT AND BUCKLE CONNECTOR

This invention relates to an improved belt and buckle connector device that enables a selected buckle to be quickly and easily attached to a particular belt.

BACKGROUND OF THE INVENTION

Conventional belts have long been made with buckles of various designs permanently attached to one end thereof. More recently, some buckles have been provided with prongs on their backside which are adapted to fit holes in the end of the belt so that it can be removably attached to one end of the belt. However, such attachment means lack the versatility that allows a user to select one of several belts and/or buckles in a desired combination and quickly and easily put it on. It is therefore one object of the present invention to provide a belt and buckle connector device that solves the aforesaid problem of prior art buckle connectors and faclitates the ease of combining a wide range of buckle and belt combinations.

Another object of the present invention is to provide a belt and buckle connector device that can be used with a wide variety of decorative buckles having irregular shapes and made of different materials.

Still another object of the invention is to provide a belt and buckle connector device that is particularly well adapted for ease and economy of manufacture.

SUMMARY OF THE INVENTION

In accordance with the principles of the present invention, a female connector member is fixed to the rear or back side of a buckle and is adapted to interconnect with male connector members that are attached to opposite ends of a belt. The female connector has a generally planar unperforate base to which is attached a connector plate having an irregular shaped opening with four equally spaced apart legs. The connector plate is attached at its periphery to the base plate and is raised from it to provide a narrow space between the two members. Each male connector member comprises a projection with an enlarged head portion that extends from a means for attaching the connector to an end of a flexible belt. When the buckle is connected to the belt on a wearer, the male connector at each end of the belt is inserted into the irregular shaped opening with its head portion between the base and the connector plate. Tension on the belt pulls the head portion to the extremity of one leg of the connector plate opening and the same happens to the male connector at the other end of the belt with respect to an opening leg on the opposite side of the connector plate. As the belt is worn normally, the tension at both ends keeps the buckle connected, but when necessary, it is quickly removed by moving one male connector toward the center of the connector plate opening. Thus, a wearer can select and quickly put on any combination of belt and buckle desired.

Other objects, advantages and features of the invention will become apparent from the following detailed description thereof presented in conjunction with the accompanying drawing.

DETAILED DESCRIPTION OF EMBODIMENTS

Figure 1:
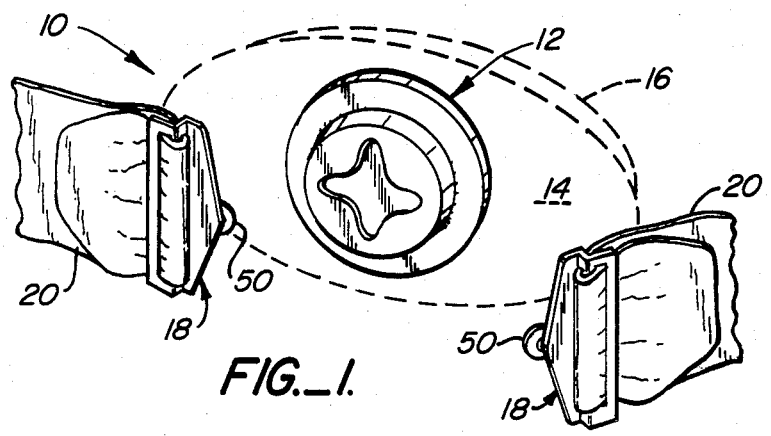
FIG. 1 is a view in perspective showing a belt and buckle connector device embodying principles of the present invention.

With reference to the drawing, FIG. 1 shows a belt buckle connector 10, embodying principles of the present invention as it appears typically when unfastened. In general, the connector 10 comprises a single female connector component 12 which is fixed to the back side 14 of a buckle 16 with a decorative front side and a pair of male connector components 18 which are attached to the ends of a flexible belt 20.

Although the buckle 16, shown in FIG. 1 has an oval shape with a generally planar back side, the present invention may be used with a wide variety of decorative or fashionable buckle designs made in various shapes from many different materials. For example, the buckle may be made from any rigid material such as wood, plastic or metal, or it may be fashioned from the natural objects of different shapes, such as sea shells, as shown in cross section by the buckle 16*a* in FIG. 8.

In all cases, the buckle itself must provide sufficient structure on its back side to support the female connector. In the embodiment of FIG. 1, the back side 14 is a metal plate, such as brass, and the female connector component 12 may be fixed thereto by fasteners such as rivets or brazing, soldering or a suitable bonding material. The front of the buckle may comprise any desired decorative material such as metal, stone or shell.

The female connector 12 comprises a flat base plate 22 of metal, such as brass, to which is attached a raised connector plate 24. The latter is brazed, welded or bonded at spaced apart locations 26 along its periphery to the base plate and has a narrow wall 28 around its outer edge that provides a space 30 between the connector plate 24 and the base plate.

Figure 7:
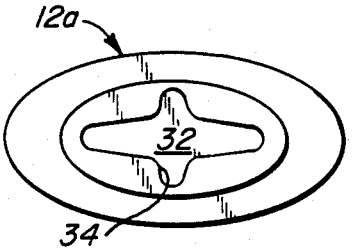
FIG. 7 is a view in front elevation of a somewhat modified female connector component.

A central opening 32 is provided in the raised connector plate 24 and is shaped in a general cruciform configuration with four radially extending legs 34 that are spaced 90° apart. The legs that are 180° apart have the same shape but the other two opposing legs may not have exactly the same shape, but may be of a different length as shown by the modified female connector 12*a* of FIG. 7.

Figure 4:
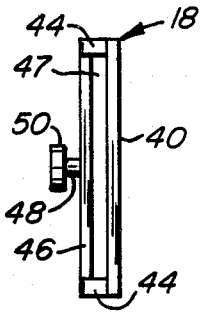
FIG. 4 is a view in side elevation of the male connector component of the device of FIG. 1.
Figure 5:
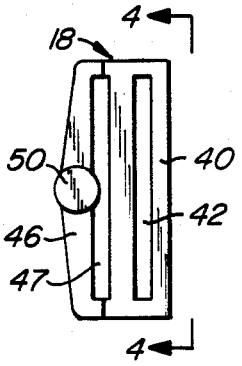
FIG. 5 is a view in front elevation of the male connector component of FIG. 4.

The male connector components 18, in the embodiment shown in FIGS. 4 and 5 each comprise a metal frame with spaced apart transverse members 38 and 40 that form an elongated loop 42 at one end. Extending outwardly from opposite ends of the central transverse member 38 at roughly an angle of 90° are interconnecting frame members 44 that are connected to opposite ends of a third transverse member 46 that forms a second elongated loop 47 with the central transverse member 38. Centrally located on this latter transverse member is a projecting stud member 48 with an elongated knob or boss 50 at its end. This knob 50 may be of any shape, such as circular or oval, and its overall size is small enough to enable it to pass through the central opening 32 in the female connector plate 24, but larger than the nominal width of the radially extending legs 34 of the opening. Thus, when inside the plate 24, the stud member 48 may be moved along to the outer end of a radially extending leg of the opening and at that location, its knob is restrained by the raised connector plate.

Figure 6:
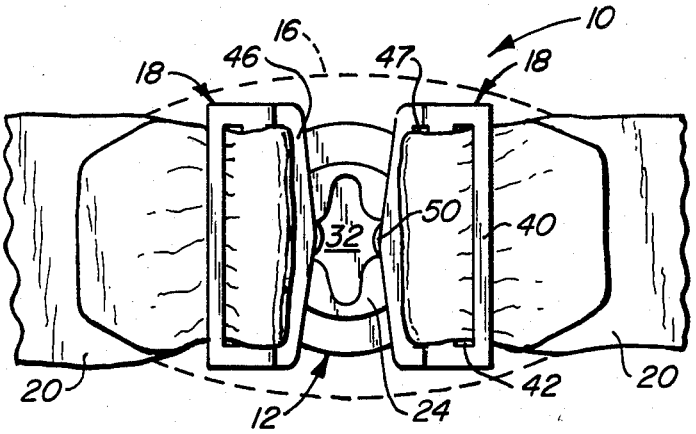
FIG. 6 is a rear view in elevation showing the belt and buckle connector device of FIG. 1 with the male and female components interconnected as in normal use.

In use, the belt buckle connector 10 is extremely versatile in that it enables a wearer to utilize any number of combinations of belts and buckles which can quickly and easily be put on or taken off. The male connector components 18 are attached to a belt, which is usually made of a highly flexible material such as cloth, leather, suede or plastic. As shown in FIGS. 1 and 6, each end of such a belt is first directed through the outer elongated loop 47, around the central transverse member 38 and back through the inner loop 42. The length of the belt between male connector components can be readily adjusted by lengthening or shortening the amount of belt extending through the loops 42 and 47, but once adjusted, the belt will not readily slide through the loop under tension because these loops are essentially in planes that are at right angles to each other.

With the male connector components adjusted, as described, a selected buckle 16 can be quickly attached when the wearer places the male connector knobs 50, one at a time within the central opening 32 of the female connector component. When the knobs at both ends of the belt are within the female connector, the tension of the belt keeps them pulled to the outer ends of the legs 34 of the opening, thereby keeping the buckle firmly attached to the belt. Yet, when the belt is to be removed, a relatively small amount of tension on one male connector and movement of its knob will release the buckle. As readily seen, many different buckles of various configuration can be provided and used with different belts to accommodate the wearer's style preference.

Figure 8:
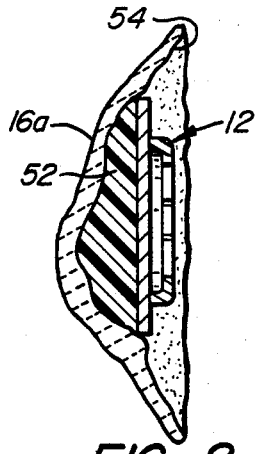
FIG. 8 is a view in side elevation and in section showing a female connector component fixed to an irregular shaped buckle according to the present invention.
Figure 2:
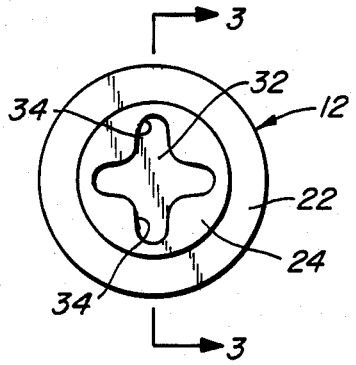
FIG. 2 is a front view in elevation of the female connector component of the device shown in FIG. 1.
Figure 3:
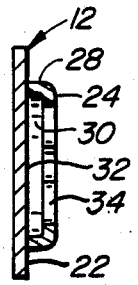
FIG. 3 is a view in section taken along line 3—3 of FIG. 2.

The connector 10 of the present invention can also be used with buckles made from irregular shapes such as sea shells, as shown in FIG. 8. A plastic material 52 such as suitable epoxy is used to fill a centrally located concavity 54 in the back side of the shell 16*a*. When solidified, this plastic material 52 provides a generally planar base support for the base plate 22 of the female connector component 12. Here, the base plate may be bonded to the plastic base 52 and held firmly in place by a suitable adhesive such as epoxy.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A quick disconnecting belt and buckle assembly comprising:

a buckle member including a base with a decorative front side and a rear side;

a female connector member fixed to said rear side and including a connector plate having an opening in a central area thereof with a plurality of narrow slots extending radially away therefrom and circularly spaced from each other by ninety degrees;

a flexible belt;

a male connector member attached to each end of said belt and each male member comprising a stud member with an enlarged knob at its outer end, said knob being small enough to pass through a central area of said opening but larger than said narrow slots; whereby tension of said belt when being worn will pull the knob of each male connector member at the opposite ends of the belt to the extremities of the oppositely extending slots when located therein, thereby holding the buckle member attached to the belt.

2. The belt and buckle assembly of claim 1 wherein said female connector member includes a base plate, said connector plate being a dished member secured to said base plate with its convex side facing away from said base.

3. The belt and buckle assembly of claim 1 wherein each said male connector member comprises three generally parallel bars that are interconnected at their respective ends to form first and second elongated loops adapted to receive an end of said belt, an outermost bar thereof supporting said stud and its knob.

4. The belt and buckle assembly of claim 2 wherein said base plate is a natural sea shell having a generally concave rear side; a plastic filler on said rear side forming a generaly planar surface; and means for securing said connector plate to said planar surface.

* * * * *